US008210377B2

(12) United States Patent
Martin et al.

(10) Patent No.: US 8,210,377 B2
(45) Date of Patent: Jul. 3, 2012

(54) CLOSURE EDGE PROTECTION VIA POLYMER COATED METAL

(75) Inventors: James L. Martin, Lancaster, OH (US); Larry A. Hottle, Granville, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 479 days.

(21) Appl. No.: 12/052,379

(22) Filed: Mar. 20, 2008

(65) Prior Publication Data

US 2009/0236353 A1 Sep. 24, 2009

(51) Int. Cl.
*B65D 41/16* (2006.01)
*B65D 41/04* (2006.01)
*B65D 53/00* (2006.01)

(52) U.S. Cl. ..... 215/349; 215/276; 215/329; 215/350; 220/780

(58) Field of Classification Search ..... 215/276, 215/329, 349; 220/281, 780
See application file for complete search history.

(56) References Cited

U.S. PATENT DOCUMENTS

| | | | | |
|---|---|---|---|---|
| 2,493,086 | A * | 1/1950 | Reifsnyder | 229/125.25 |
| 3,270,904 | A | 9/1966 | Foster et al. | |
| 3,285,452 | A | 11/1966 | Moloney et al. | |
| 3,323,672 | A | 6/1967 | Acton | |
| 3,446,381 | A | 5/1969 | Podesta et al. | |
| 3,912,102 | A | 10/1975 | Michel | |
| 3,913,772 | A | 10/1975 | Ochs | |
| 3,933,267 | A | 1/1976 | Rohde | |
| 4,209,126 | A | 6/1980 | Elias | |
| 4,705,183 | A | 11/1987 | Moloney | |
| 4,807,770 | A * | 2/1989 | Barriac | 215/252 |
| 4,809,858 | A * | 3/1989 | Ochs | 215/276 |
| 4,982,872 | A | 1/1991 | Avery | |
| 5,093,208 | A * | 3/1992 | Heyes et al. | 428/623 |
| 5,103,991 | A | 4/1992 | Collins | |
| 5,190,177 | A | 3/1993 | Collins | |
| 5,443,853 | A | 8/1995 | Hayes | |
| 5,555,988 | A | 9/1996 | Koch et al. | |
| 5,685,443 | A | 11/1997 | Taber et al. | |
| 6,375,023 | B1 | 4/2002 | Lecinski et al. | |
| 6,868,978 | B2 | 3/2005 | Amschlinger et al. | |
| 2009/0178995 | A1 * | 7/2009 | Tung et al. | 215/329 |

FOREIGN PATENT DOCUMENTS

| | | | |
|---|---|---|---|
| WO | WO 98/03406 | A1 | 1/1998 |
| WO | WO 2005/019059 | A1 | 3/2005 |

* cited by examiner

*Primary Examiner* — Anthony Stashick
*Assistant Examiner* — Madison L Wright
(74) *Attorney, Agent, or Firm* — Woodcock Washburn LLP

(57) ABSTRACT

Metal closure components and methods for making the same are provided. The closures may be formed from a metal sheet having a pre-formed polymer film adhered on at least one face. A circular blank may be cut from the sheet, such that the blank may have a circular "raw" cut edge unprotected by the polymer film. The metal blank may then be formed such that the cut edged may be embedded into the film.

12 Claims, 4 Drawing Sheets

CLOSURE EDGE PROTECTION VIA POLYMER COATED METAL

FIELD OF THE TECHNOLOGY

The technology relates to closures. In particular, the technology relates to metal or composite closures.

BACKGROUND

Composite closures typically include a metal or plastic insert disk and a plastic peripheral band. The insert disk may form a seal with a mouth of a container and usually is held in place by a vacuum within the container.

All-metal closures are an alternative to composite closures. All-metal closures, such as those on many baby food jars, include an integral top portion and skirt. The skirt may have threads or discontinuous lugs to provide mechanical engagement with a container neck finish.

The top and bottom surfaces of the metal used for insert disks or metal closures typically are coated with a solvent-based, water-based, or UV-curable coating or other composition that provides decoration, protection from scratching, adhesion for a gasket material, and/or inhibits corrosion. But because a blank for the insert disk or closure is typically cut from pre-coated sheets, the edge at the periphery of the disk (that is, the "cut edge") is uncoated when cut.

Conventional processes either specifically coat the cut edge with a corrosion preventing material or roll it into a curl so that any corrosion is hidden by the curl. In the case of the cut-edge being rolled into a curl, while any corrosion is "hidden," it is possible that water can be trapped in the curl promoting corrosion of the cut edge which can subsequently "bleed out" of the curl and be deposited onto the container, causing unsightly staining which is unacceptable to the end user of the package.

SUMMARY

A closure component formed from a metal sheet and having a cut edge is provided. The closure component may be formed to prevent certain corrosion of the cut edge when in the presence of oxygen and water, steam, humid air or other corrosion inducing media.

One example of a closure component is an insert disk for a composite closure. The insert disk may have a pre-formed polymer layer on at least one of its surfaces and may include a circular body and a rim portion. The rim portion may be joined to the circular body by a first bend. The rim portion may also be joined to a cut edge by a second bend such that the cut edge may be embedded into the polymer film layer to resist corrosion of the cut edge.

Another example of a closure component is an all metal closure. The metal closure may have a pre-formed polymer layer on at least one of its surfaces and may include a circular body, a peripheral skirt, and a rim portion. The peripheral skirt may extend downwardly from the circular body. The rim portion may be joined to the peripheral skirt by a first bend. The rim portion may also be joined to a cut edge by a second bend such that the cut edge may be embedded into the polymer layer to resist corrosion of the cut edge.

The closure components may be formed from a metal sheet having a pre-formed polymer layer adhered onto at least one of its surfaces. Initially, a circular blank may be cut from the sheet, such that the blank may have a circular "raw" cut edge unprotected by the polymer layer. The metal blank may then be formed such that the cut edge may be embedded into the polymer layer, thereby protecting the cut edge from certain corrosion inductive media.

DETAILED DESCRIPTION OF ILLUSTRATIVE EMBODIMENTS

Preferred structures and methods for employing edge protection technology are described herein. Embodiments of closures that employ this technology are also described. The present invention is not limited to any particular closure configuration but rather encompasses use in any closure application. Further, the present invention encompasses configurations and methods related to polymer coated metal edges.

Figure 1:
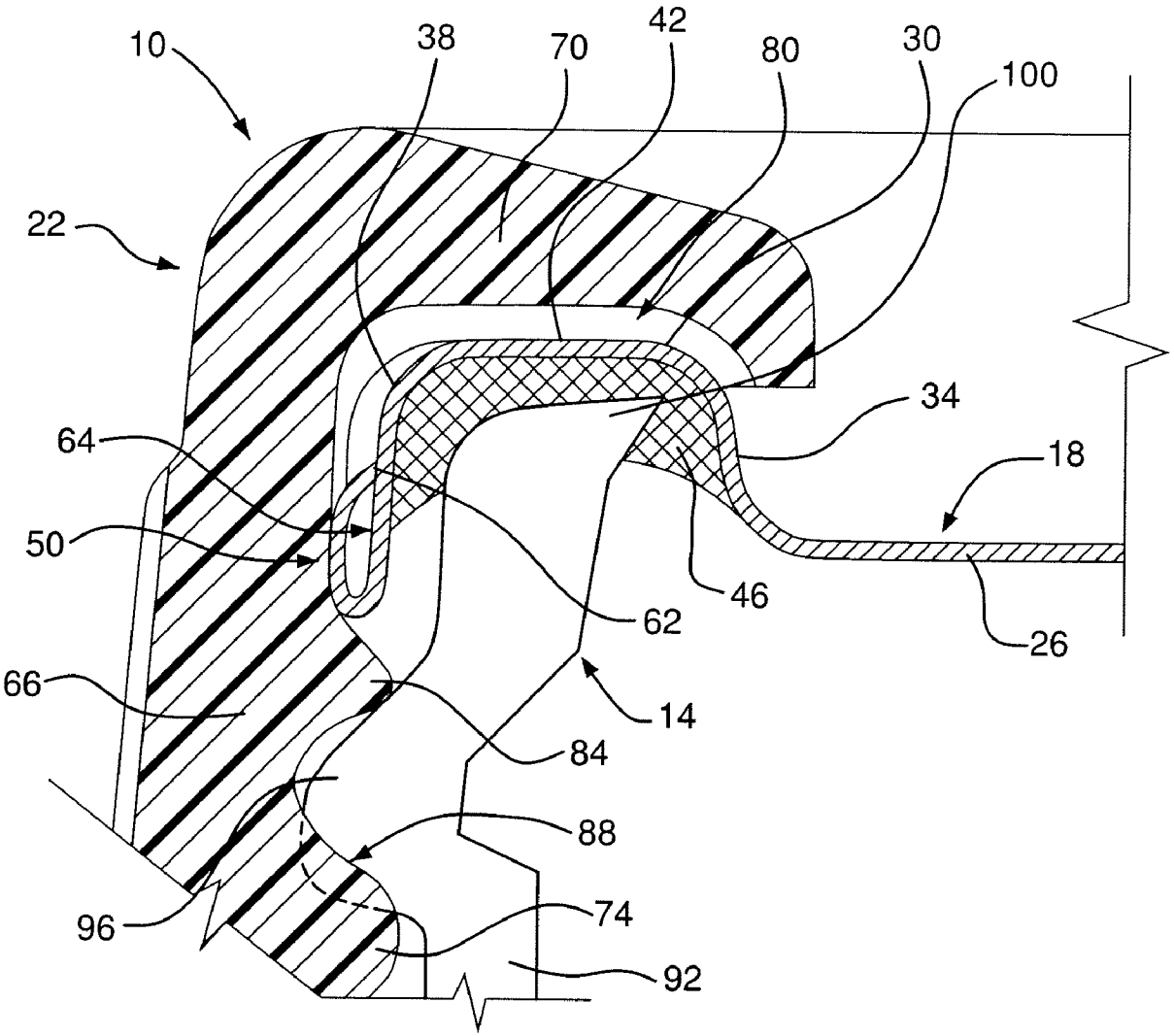
FIG. 1 is a partial longitudinal cross sectional view of a closure and container assembly, illustrating an embodiment of the present invention.

As shown in FIG. 1, a closure and container combination includes a composite closure 10 and a corresponding container 14. Closure 10 includes an insert disk 18 and circumferential band 22. The insert disk 18 is typically formed of metal, and the circumferential band 22 is typically formed of plastic, as will be understood by persons familiar with composite closure technology.

Insert disk 18 includes a center portion 26 and an annular channel 30 disposed circumferentially about the center portion 26. The annular channel 30, which may be substantially downward-facing, is formed by an inboard wall 34 and an outboard wall 38 with an upper wall 42 formed therebetween. The channel upper wall 42 forms a substantially flat top surface. A sealant 46, such as plastisol or other conventional material, may be disposed in the channel 30. As shown, the channel inboard wall 34 has a sloped profile, in cross section, and channel outboard wall 38 has a substantially vertical profile, although any configuration is contemplated.

As shown, a rim portion 50 is formed at the lower end of channel outboard wall 38, and extends radially outwardly. The rim portion 50 may be a curl and includes a cut edge 62. The cut edge 62 curves generally radially outwardly at the bottom portion of channel outboard wall 38 and then curves radially inwardly such that the cut edge 62 is embedded in an outer surface 64 of the channel outboard wall 38. That is, the cut edge 62 contacts the outer surface 64 of channel outboard wall 38, such that the cut edge 62 is protected from corroding when in the presence of oxygen and water, steam, humid air or other corrosion inducing media.

As shown, band 22 includes an annular skirt 66 and a ring 70 extending radially inwardly from an upper portion of the skirt 66. Threads 74 extend radially inwardly from an interior portion of skirt 66. Depending on the position of band 22 relative to container 14 and disk 18, the underside of ring 70 and channel third wall 42 are spaced apart to form a gap 80.

Above threads 74, a retaining feature, such as bead 84, extends substantially radially inwardly from skirt 66. Alternatively, retaining bead 84 may be omitted and the closure may be configured such that a top portion 88 of the closure threads 74 may perform the function of the retaining bead 84. In this regard, the term "retaining feature" encompasses retaining bead 84, closure thread top portion 88 and any other structure that performs the retaining function and/or opening function.

The container 14, with which closure 10 may be coupled, includes a neck 92 having threads 96 and forming a rim 100. As in conventional closures and containers, rim 100 protrudes into channel 30 such that sealant 46 is deformed to enhance a seal between disk 18 and container 14.

Figure 2A:
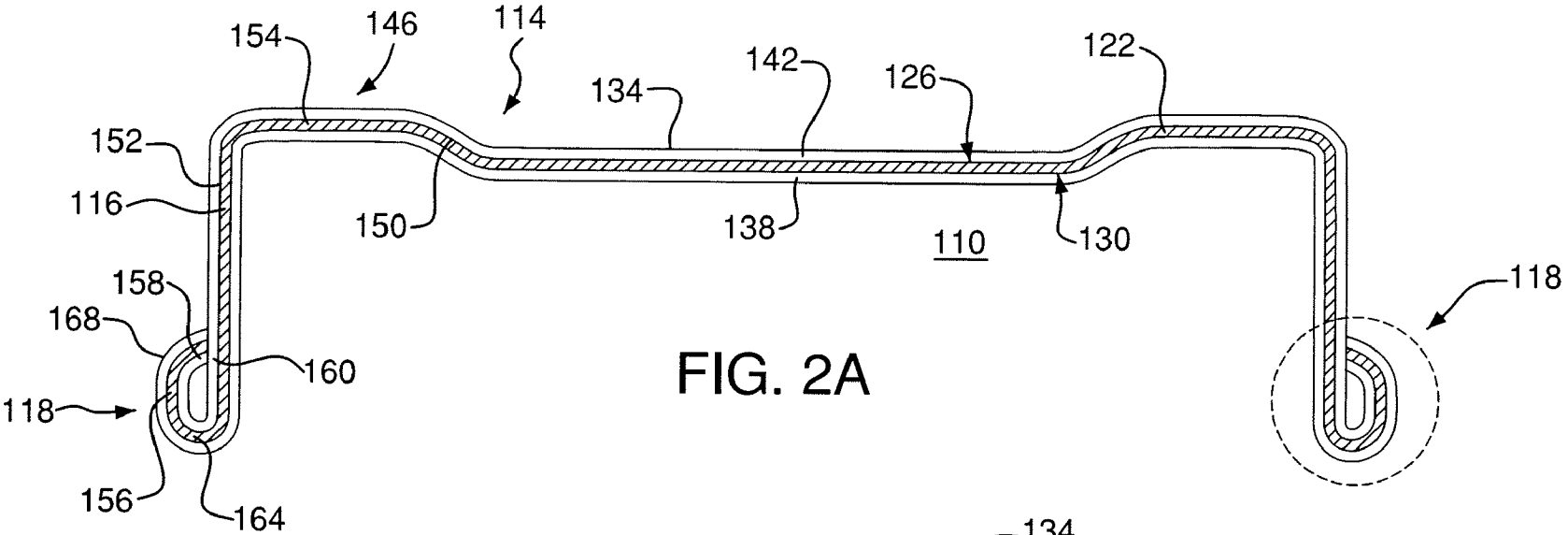
FIG. 2A is a cross sectional view of an insert disk, illustrating an embodiment of the invention.

FIG. 2A depicts a cross-section of an example insert disk. As shown, insert disk 110 includes a circular body 114, a downwardly depending peripheral skirt 116, and a rim portion 118. The rim portion 118 may extend from an end of the peripheral skirt 116. The insert disk 110, including the circular body 114, the peripheral skirt 116, and rim portion 118 are comprised of a metal piece 122 having a top surface 126 and an underside surface 130. The insert disk 110 may also be comprised of a first coating layer 134 disposed on the top surface 126 and a second coating layer 138 disposed on the underside surface 130. It should be understood that peripheral skirt 116 is optional, and that rim portion 118 may extend from the circular body 114.

As shown, the circular body 114 includes a center portion 142 and an annular channel 146 disposed circumferentially about the center portion 142. The annular channel 146, which is substantially downward-facing, includes an inboard wall 150 extending up from the center portion 142, an outboard wall 152 and a top portion 154 extending therebetween. The top portion 154 may be substantially flat and parallel to the center portion 142. The inboard wall 150 may have a sloped profile in cross section, and the outboard wall 152 may have a substantially vertical profile.

The rim portion 118 extends circumferentially about an end of the peripheral skirt 116 and includes a first portion 156, a second portion 158 and a cut edge 160. The first portion 156 extends from the peripheral skirt 116 at a first bend 164. As shown, the first bend 164 forms an included angle of approximately 180 degrees, and the first portion 156 is substantially parallel to the peripheral skirt 116 and outboard wall 152. The second portion 158 extends from the first portion 156 at a second bend 168. As shown, the second bend 168 forms an included angle of approximately 90 degrees. The end of the second portion 158, that is, the cut edge 160 then terminates at the coating layer 134.

Figure 2B:
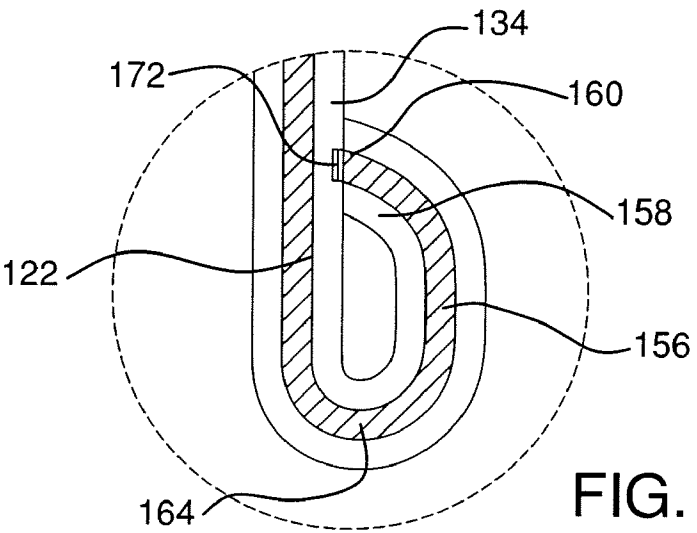
FIG. 2B is an enlarged view of a cut edge of the insert disk shown in FIG. 2A.

As shown in FIG. 2B, the cut edge 160 is embedded in the first coating layer 134. That is, the cut edge 160 contacts the first coating layer 134 such that the previously exposed metal edge of the insert disk 110 is no longer exposed to corrosion inducing media. For example, an edge or tip 172 of the metal piece 122 of the insert disk 110 may be embedded into the first coating layer 134 by a distance of 0.1-1.0 mm.

Figure 3:
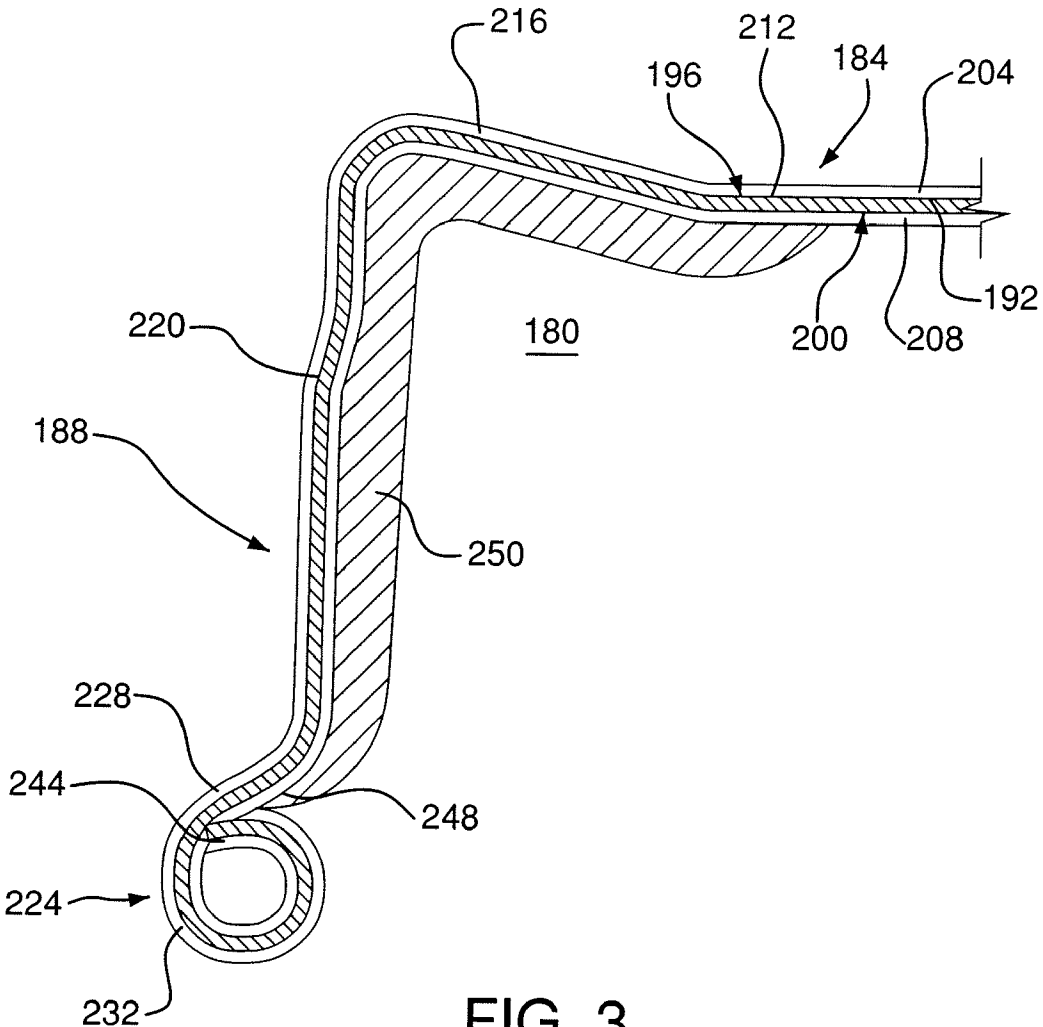
FIG. 3 is a partial longitudinal cross sectional view of an all metal closure, illustrating an embodiment of the invention.

FIG. 3 depicts an example all metal closure. As shown, an all metal closure 180 includes a circular body 184, and a peripheral skirt 188. The all metal closure 180, including the circular body 184 and peripheral skirt 188 is comprised of a metal piece 192 having a top surface 196 and an underside surface 200. The all metal closure 180 is also comprised of a first coating layer 204 disposed on the top surface 196 and a second coating layer 208 disposed on the underside surface 200.

As shown, the circular body 184 includes a center portion 212 and an edge portion 216. The edge portion 216 extends from the circular body 184 at an angle. For example, the edge portion 216 may extend from the circular body 184 at an angle of 5.0-18.0 degrees.

The all metal closure 180 may also include a gasket 250. The gasket 250 may be disposed on a portion of the underside surface 200. For example, the gasket 250 may be disposed on the peripheral skirt 188 and circular body 184. The gasket 250 will help seal in the contents of a container when the container and closure engage each other.

As shown, the peripheral skirt 188 extends downwardly from the edge portion 216, and includes a wall portion 220 and a rim portion 224. As shown, the rim portion 224 may be a curl and is formed at the lower end of the wall portion 220. The rim portion 224 first extends radially outwardly at a first bend 228 and then radially inwardly at a second bend 232 at a relatively constant radius of curvature. The rim portion 224 includes a cut edge 244. The cut edge 244 curves generally radially inwardly and then curves radially outwardly such that the cut edge 244 embeds into a surface 248 of the peripheral skirt 188. That is, the cut edge 244 contacts the second coating layer 208 such that the cut edge 244 is protected from corrosion when in the presence of oxygen and water, steam, humid air or other corroding inducing media. It shall be understood that the rim portion 224 is not limited to the disclosed embodiment. For example, the cut edge 244 may curve generally radially outwardly and then may curve radially inwardly such that the cut edge 244 may embed into the first coating 204.

The insert disk and all metal closure are made by cutting a circular metal blank. Before cutting, each side of the metal is coated with a polymeric coating layer. It should be understood, however, that both sides do not have to be coated and that only one side of the metal may be coated. The coatings, such as the first coating layers 134 and 204, and the second coating layers 138 and 208 shown in FIGS. 2A and 3, may be conventional coatings or laminates of polymer film, for example. Preferably, the metal blank is formed of coated steel, which is generally referred to as a polymer coated metal.

Conventional coatings may contain polymers and may be applied as a liquid (i.e. paint) onto the metal which may then be subsequently heated or cured by radiation (normally ultraviolet radiation or electron beam), resulting in a film being formed it-situ on the metal surface. Materials that may be used are polyester, epoxy, epoxy ester, acrylic, vinyl, phenolic or any other material having a Type D 80-100 hardness as measured on a Durameter.

Alternatively, the metal may be covered by a laminate of polymer film that has an existence independent of the metal. That is, a pre-existing polymer film may be adhered onto the surfaces of the metal. The film may have a variety of thicknesses. For example, the film may be between 7-50 microns thick. Materials that may be used are polypropylene, polyethylene, PET, or any other material having a Type A 50-100 hardness as measured on a Durameter. It should be understood by those skilled in the art, that the laminate of polymer film may also be foamed.

The edge of the blank, that is the cut edge, typically has no film on it and remains exposed during subsequent forming of the metal into the finished closure. The cut edge can corrode in the presence of corrosive media such as water, steam, or humid air, if the metal used (e.g. steel) is subject to corrosion.

Figure 4C:
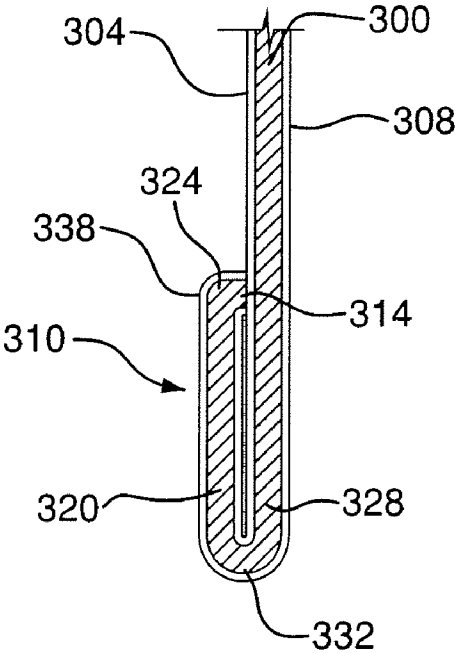
FIG. 4C is a partial cross sectional view of the coated piece of metal shown in FIG. 4A fully crimped.
Figure 4B:
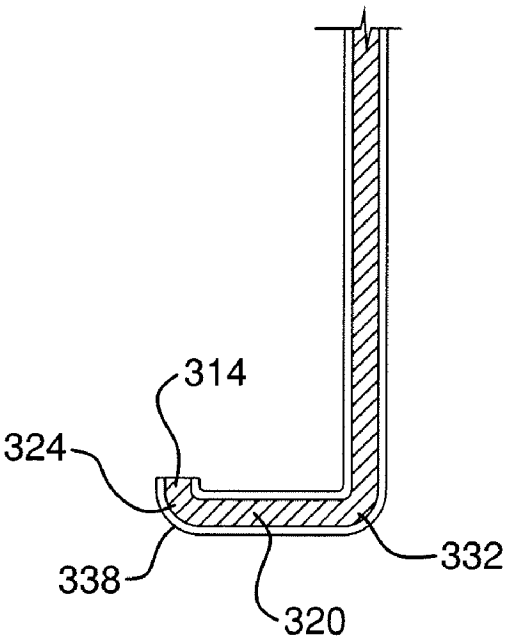
FIG. 4B is a partial cross sectional view of the coated piece of metal shown in FIG. 4A partially crimped.
Figure 4A:
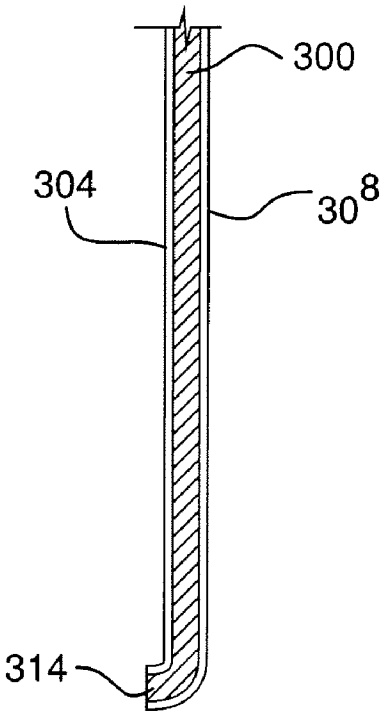
FIG. 4A is a partial cross sectional view of a coated piece of metal.

FIGS. 4A-4C depict how a metal blank 300 having a first coating layer 304 and a second coating layer 308 may be formed to create a rim portion 310. As shown, rim portion 310 has a cut edge 314 embedded into the first coating layer 304, thus preventing its contact with oxygen and corrosion-inducing media. FIG. 4A depicts the cut edge 314 of the metal blank 300 completely exposed. FIG. 4B depicts the metal blank 300 in the process of being formed. FIG. 4C shows the final crimp, wherein the cut-edge 314 is embedded in the coating layer 304. That is, the cut edge 314 contacts the coating layer 304 such that the cut edge 314 is protected from corrosion when in the presence of oxygen and water, steam, humid air or other corroding inducing media. As shown in FIG. 4C, the rim portion 310 further includes a first portion 320, and a second portion 324. The first portion 320 extends from a wall portion 328 at a first bend 332. As shown, the first bend 332 forms an included angle of approximately 180 degrees, and the first portion 320 is parallel to the wall portion 328. The second portion 324 extends from the first portion 320 at a second bend 338. As shown, the second bend 338 forms an included angle of approximately 90 degrees. The end of the second portion 324, that is, the cut edge 314 then terminates at the first coating layer 304. As shown, the first portion 320 is in contact with the wall portion 328. Such an orientation may further help keep water from corroding the metal.

In some cases it may be beneficial to heat the crimped closure. Such heating may soften the coatings and allow the cut edge to penetrate and embed slightly into the polymer film. The crimped closures may be heated by induction or other conventional heating methods.

What is claimed:

1. An insert disk for a composite closure, the insert disk being formed of a pre-coated metal that defines a top surface pre-coated with a top surface coating, and a bottom surface pre-coated with a bottom surface coating the insert disk comprising:

a circular body, a peripheral skirt, and a rim portion, the rim portion joined to the peripheral skirt by a first bend and the rim portion joined to a cut edge by a second bend such that the cut edge is embedded into either the top surface coating or the bottom surface coating to resist corrosion of the cut edge.

2. The insert disk of claim 1 wherein the rim portion is parallel to the peripheral skirt.

3. The insert disk of claim 2 wherein the rim portion is in contact with the peripheral skirt.

4. The insert disk of claim 1 wherein the first bend forms an included angle of approximately 180 degrees and the second bend forms an included angle of approximately 90 degrees.

5. The insert disk of claim 1 wherein the cut edge is embedded into the top surface coating and not into the bottom surface coating.

6. The insert disk of claim 1 wherein the cut edge is embedded into the bottom surface coating and not into the top surface coating.

7. A metal closure formed of a pre-coated metal that defines a top surface pre-coated with a top surface coating, and a bottom surface pre-coated with a bottom surface coating, the metal closure comprising:

a circular body, a peripheral skirt extending downwardly from the circular body, and a rim portion joined to the skirt by a first bend, the rim portion joined to a cut edge by a second bend such that the cut edge is embedded into either the top surface coating or the bottom surface coating to resist corrosion of the cut edge.

8. The closure of claim 7 wherein the rim portion is parallel, in cross section, to the peripheral skirt.

9. The closure of claim 8 wherein the rim portion is in contact with the peripheral skirt.

10. The closure of claim 7 wherein the first bend forms an included angle of approximately 180 degrees and the second bend forms an included angle of approximately 90 degrees.

11. The metal closure of claim 7 wherein the cut edge is embedded into the top surface coating and not into the bottom surface coating.

12. The metal closure of claim 7 wherein the cut edge is embedded into the bottom surface coating and not into the top surface coating.

* * * * *